US005426798A

United States Patent [19]

Guarino

[11] Patent Number: 5,426,798

[45] Date of Patent: Jun. 27, 1995

[54] RESTING SUPPORT PARTICULARLY ADAPTED FOR PRONE SLEEPING

[76] Inventor: Frank V. Guarino, 480 Ocean Blvd., West End, N.J. 07740

[21] Appl. No.: 131,007

[22] Filed: Oct. 1, 1993

Related U.S. Application Data

[63] Continuation-in-part of Ser. No. 985,905, Dec. 4, 1992, abandoned.

[51] Int. Cl.[6] ..... A61G 7/00; A47C 27/00

[52] U.S. Cl. ..... 5/461; 5/638; 5/648

[58] Field of Search ..... 5/461, 638, 648, 631, 5/462, 468, 902; D6/596, 601, 604, 605

[56] References Cited

U.S. PATENT DOCUMENTS

| | | | |
|---|---|---|---|
| D. 337,914 | 8/1993 | McDonald | 5/638 |
| 2,182,861 | 12/1939 | Albert | 5/465 |
| 2,244,435 | 6/1941 | Simons | 5/461 |
| 2,810,920 | 10/1957 | Carruth | 5/638 |
| 3,315,282 | 4/1967 | Lowery et al. | 5/638 |
| 3,362,031 | 1/1968 | Lemly | 5/461 |
| 4,535,878 | 8/1985 | Grahl | 5/638 |
| 4,596,384 | 6/1986 | Blosser | 5/638 |
| 4,710,991 | 12/1987 | Wilmore et al. | 5/638 |
| 4,891,854 | 1/1990 | Finkelstein | 5/638 |
| 5,222,779 | 6/1993 | Johnson | 5/638 |

*Primary Examiner*—Alexander Grosz
*Attorney, Agent, or Firm*—Galgano & Burke

[57] ABSTRACT

A resting support, for example, a mattress, comprises an interior slot designed to support a person resting in the prone position. One embodiment comprises a slot having a first sidewall which extends at an angle downwardly from the substantially planar resting surface and a second sidewall which extends from a lower portion of the first sidewall, preferably at an angle which is steeper than the angle of the first sidewall. Also disclosed is a boxspring having a corresponding, and preferably, larger opening. A removable, supplemental facial support is also disclosed.

64 Claims, 8 Drawing Sheets

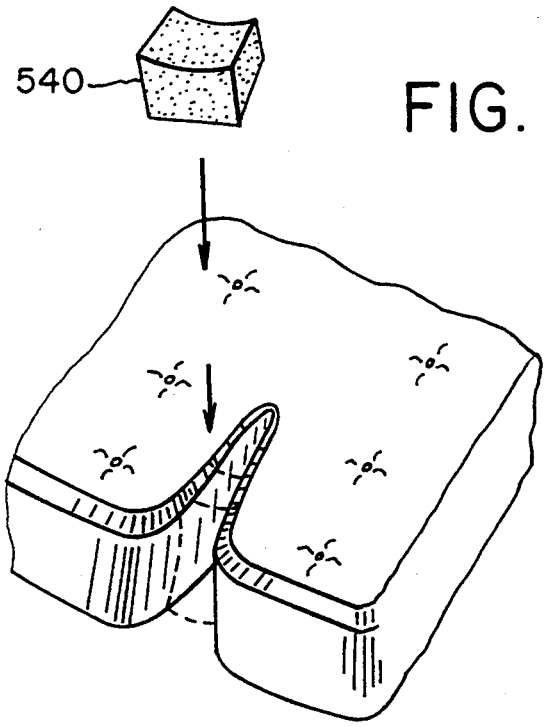
FIG. 12
FIG. 16
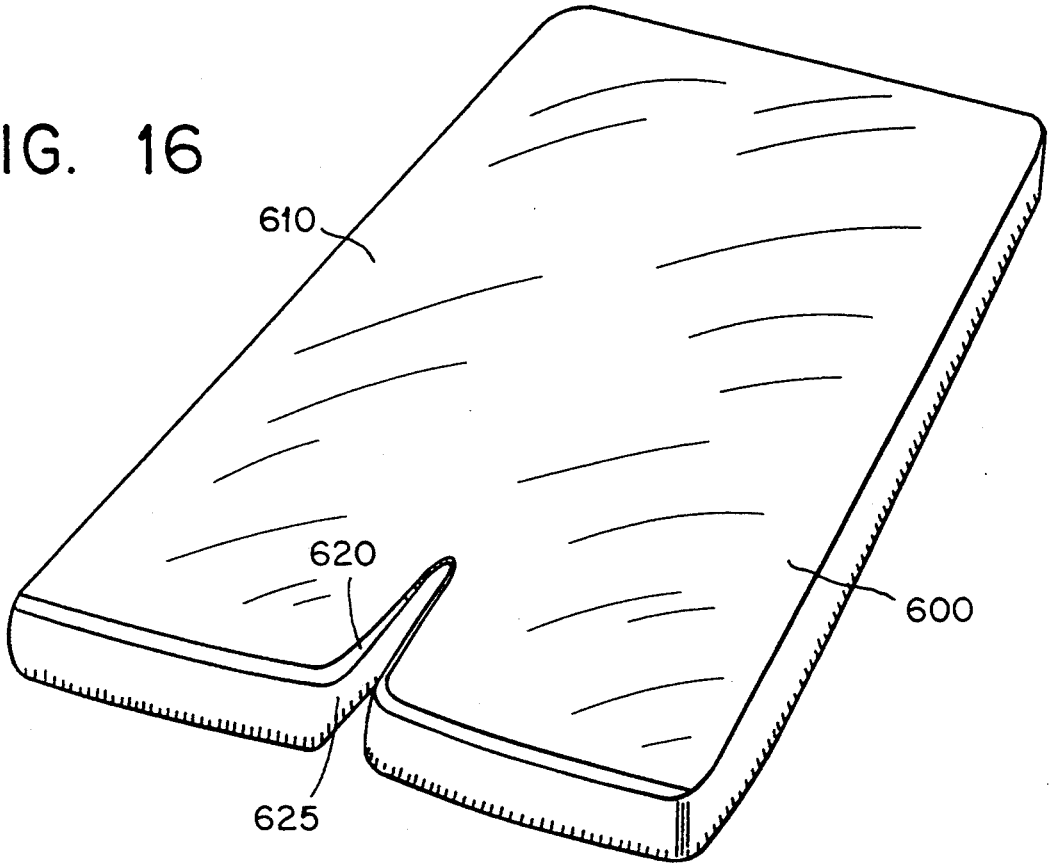

FIG. 13
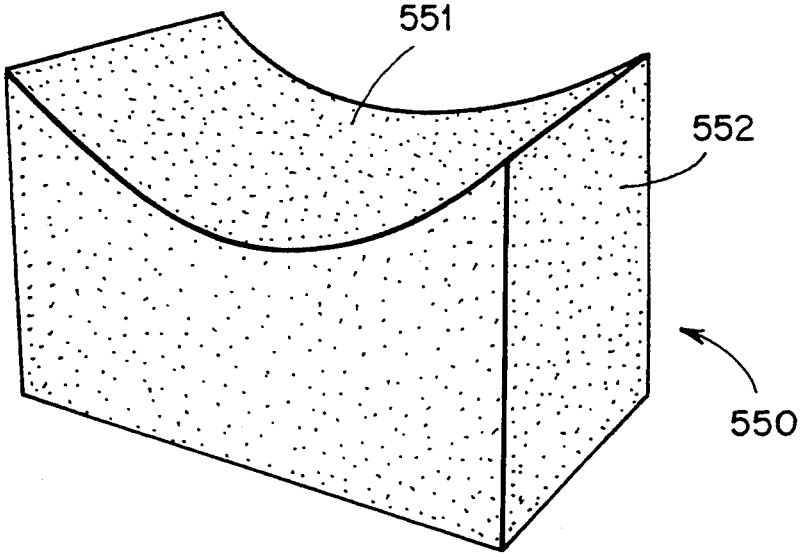
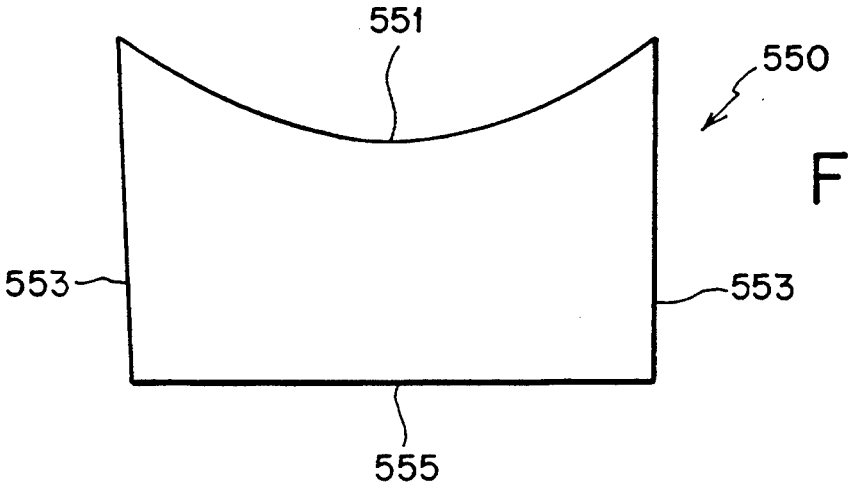
FIG. 14
FIG. 15
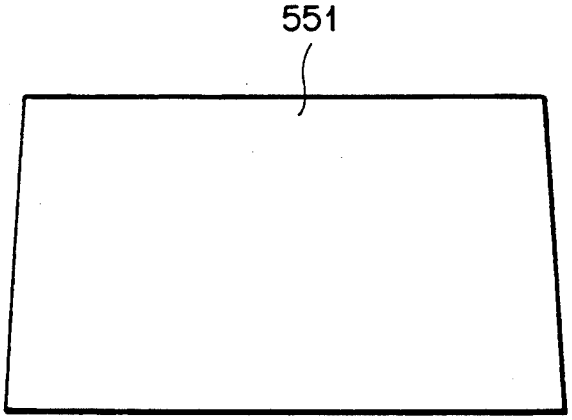

RESTING SUPPORT PARTICULARLY ADAPTED FOR PRONE SLEEPING

RELATED APPLICATION

This application is a Continuation-In-Part of U.S. patent application Ser. No. 07/985,905 filed on Dec. 4, 1992 now abandoned.

BACKGROUND OF THE INVENTION

The present invention is directed to a mattress for a person resting, and, more particularly, to a support designed to comfortably accommodate a person sleeping in a prone position.

Most people spend about one-third of their lives sleeping or resting. It is widely accepted in the medical field that proper rest is needed in order to sustain a healthy lifestyle. Poor bedding support, improper sleeping positions, particularly misalignment of the neck during sleeping can lead to a wide variety of physical and, consequently, psychological ailments. Cervical (neck) distortion aggravates, directly and indirectly, vertebral position, muscles and nerves dependent upon those positions. There is also a recognized correlation between cervical distortion and lumbar (low back) function. Such distortion does not necessarily correct itself and can lead to subluxations (vertebral misalignments), nerve interference, muscular aches and pains. The ailments can cause a person to be less functional, less productive, less restful and irritable. These ailments can have a high cost to society in lost work days, medical visits, ancillary treatments and collectively contribute to the present strain on the health care systems of society.

With a conventional mattress, people desiring to sleep in a prone, i.e. face down, position are required to turn their heads in order to breathe. Prolonged fixation of the neck in this position creates muscular, vascular and spinal stresses which can lead to pain not only in the neck but also in the fingers, head, shoulders and arms. Lower back problems caused or exacerbated may require expensive professional treatment.

In light of the desire for many people to sleep in the prone position and the recognized disadvantages of having people sleep on their stomachs while turning their heads to breathe, mattresses have been previously proposed which provide openings near the superior end of a mattress to accommodate a person's head while allowing the free flow of needed air. Such prior attempts to design a mattress which comfortably supports a person sleeping in a prone position, however, had serious shortcomings. For example, some prior designs had rectangular openings which did not comfortably accommodate different head sizes and face shape differences. Such openings also did not provide for variations in facial-mattress contact by the person sleeping during a resting period. Other such prior mattresses proposed for prone sleeping positions, were provided with circular or oval openings which were also limited to faces and heads having certain sizes.

In light of the shortcomings of such prior mattresses, it is desirable to provide a mattress which allows a person to rest comfortably in the prone position without requiring neck twisting for the person to breathe. It is also highly desirable to provide a mattress which can comfortably accommodate different head sizes and face shapes comfortably.

Furthermore, it is also desirable to provide a mattress which allows a person to sleep comfortably in the prone position while permitting variation of facial-mattress contact during resting.

SUMMARY OF THE INVENTION

One embodiment of the present invention is directed to a mattress comprising at least one opening proximate the superior end of the mattress which allows a person to rest comfortably in a prone position without requiring that person to turn his neck in order to breathe comfortably. According to one embodiment of the present invention, an opening is defined by interior sidewalls of the mattress which taper generally continuously, inwardly toward the inferior end, i.e. the feet end, of the mattress. In addition to tapering inwardly as measured from the superior end to the inferior end of the mattress, the interior sidewalls of this embodiment of the present invention taper inwardly for at least a portion of the depth of the opening.

The generally continuous taper from the superior end to the inferior end of the mattress, advantageously provides flexibility with respect to the head sizes and face shapes which can be comfortably supported by the opening. This taper also allows a person sleeping in the prone position to vary the portions of his face which are being contacted by the sidewalls of the mattress opening by simply moving slightly toward the superior or inferior end of the mattress as desired.

According to another embodiment of the present invention, an interior opening is defined by a first interior sidewall which extends from the top of the resting support and tapers downwardly in the direction of a central, longitudinal axis of the opening, and a second interior sidewall which extends further downwardly from a lower portion of the first interior sidewall at an angle which is steeper than the angle of the first interior sidewall. In a preferred version of this embodiment, the first interior sidewall is substantially flat in order to maximize the mattress-facial contact.

Another embodiment of the present invention comprises selectively removable inserts which may be employed to fill the opening when a person does not want to use the opening. Alternatively, a removable insert can serve to provide additional facial support.

A still further embodiment of the present invention provides an adjustment member for adjusting the width of the superior portion of the opening in order to even further increase the range of head sizes and face shapes which can be comfortably supported in the prone position.

The present invention also comprises coverings for the resting supports and mattresses disclosed herein. These and other embodiments are described in further detail below.

BRIEF DESCRIPTION OF THE DRAWINGS

FIG. 12 illustrates an alternative embodiment of the present invention comprising a supplemental facial support.

FIG. 13 is a perspective view of the supplemental facial support shown in FIG. 12.

FIGS. 14 and 15 are side and top views, respectively, of the supplemental support shown in FIG. 13.

FIG. 16 is a perspective view of a mattress cover in the form of a sheet of one embodiment of the present invention.

DETAILED DESCRIPTION

The present invention is directed to mattresses specifically designed to allow a person to sleep comfortably in the prone position. As used herein, the term "mattress" is used to include bedding having a supporting depth of at least 3 inches, preferably 6 inches, designed to provide enough resiliency to comfortably support a person sleeping for extended periods of 6–8 hours. The mattresses of the present invention may be formed of any suitable material such as those conventionally used in mattress construction. The thickness, which in most embodiments will define the depth of the opening, may vary with construction, but is preferably at least three inches, and most preferably about 6–7 inches.

Figure 1:
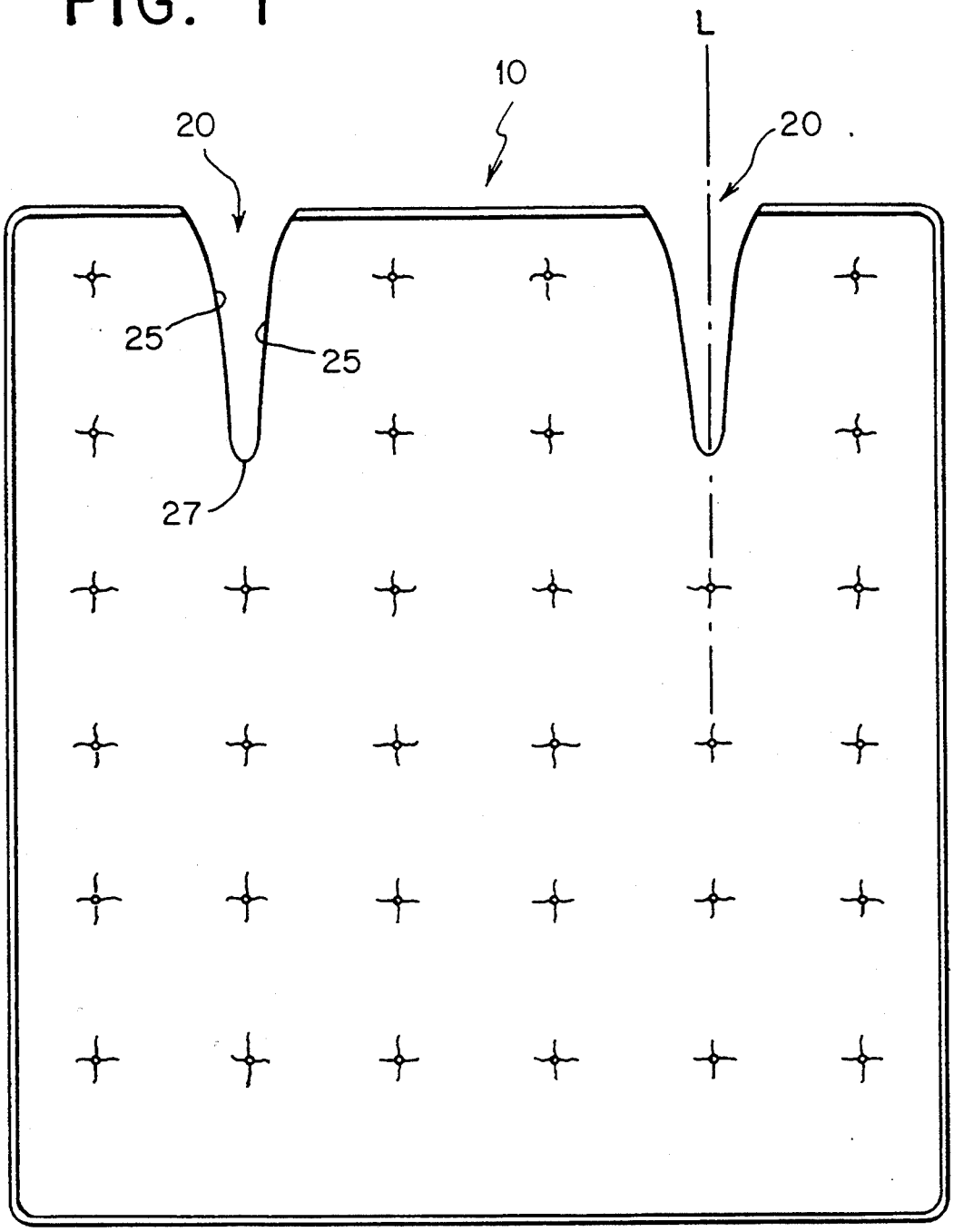
FIG. 1 is a top view of a mattress of one embodiment of the present invention which is designed for two people.
Figure 2:
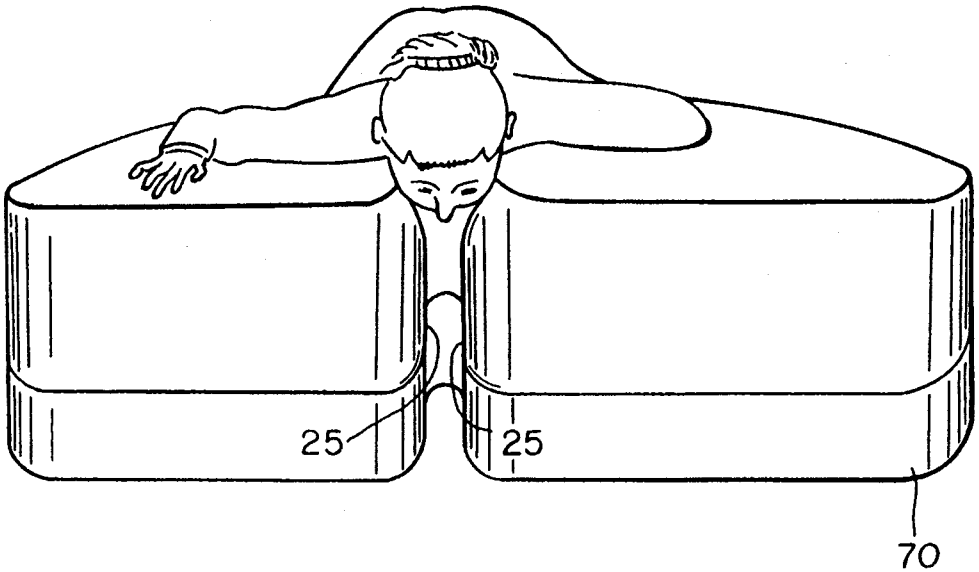
FIG. 2 is a perspective view of a single size mattress showing a placement of a person's face in the opening.

According to one embodiment of the present invention illustrated in FIGS. 1 and 2, a mattress, of a size suitable for accommodating two adult persons, is provided with a pair of openings 20. The openings 20 are advantageously designed to comfortably support the head of a person sleeping on mattress 10 in the prone position. As shown in FIG. 1, both openings 20 are provided proximate the superior end, i.e. the head end, of the mattress. Since both openings 20 of this embodiment of the present invention are identical, only one of the openings will be described in detail herein.

According to this embodiment, opening 20 extends entirely through mattress 10 in order to allow the free circulation of air to and from the face of a resting person. It is preferred, but is not necessary, that the opening extend through the entire depth of the opening. In order to maximize comfort to the resting person, opening 20 is tapered in two directions. As shown in FIG. 1, the sidewalls 25 taper inwardly, in a substantially continuous and gradual fashion from the superior end of the mattress toward the inferior end, i.e. feet end, of the mattress. Opening 20 may be formed with different lengths, widths and angles of taper without departing from the scope of the present invention. One preferred embodiment has a length, as measured along a central longitudinal axis L shown in FIG. 1, of about 10 to 25 inches, preferably about 18–20 inches. The superior end of the mattress of this embodiment has an opening with a width of about 8 to 12 inches, most preferably about 9–10 inches and tapers, substantially continuously such that at a second point on longitudinal access L two inches away from the inferior end of opening 20, the opening has a width of about 1.5–4 inches, preferably about 2–3 inches. From that second point about two inches from the inferior end of opening 20, the sidewalls 25 of opening 20 converge smoothly but more quickly to form a smooth, rounded inferior end 27.

FIG. 2 illustrates a portion of the embodiment of the present invention shown in FIG. 1 with a person lying in the prone position with her head supported comfortably within opening 20. The second direction of taper is shown by sidewalls 25 of opening 20 which are generally convex and taper inwardly toward longitudinal access L for at least a portion of their downward extension into the depth of opening 20. This inward taper of sidewalls 25 provides a greater contact area between the resting person's face and the mattress 10 than would sidewalls which extend only vertically. This contact is referred to herein as "facial-mattress" contact. In less preferred embodiments which are not illustrated, the sidewalls extend vertically or meet proximate the bottom of the mattress. Those skilled in the art will appreciate that the illustrated embodiments are preferred since they provide the user with the option of flipping the mattress while still enjoying the benefits of the present invention.

Figure 5:
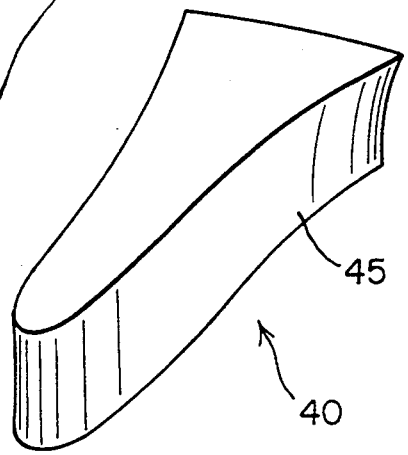
FIG. 5 is a top, perspective view of the insert shown in FIG. 4.
Figure 4:
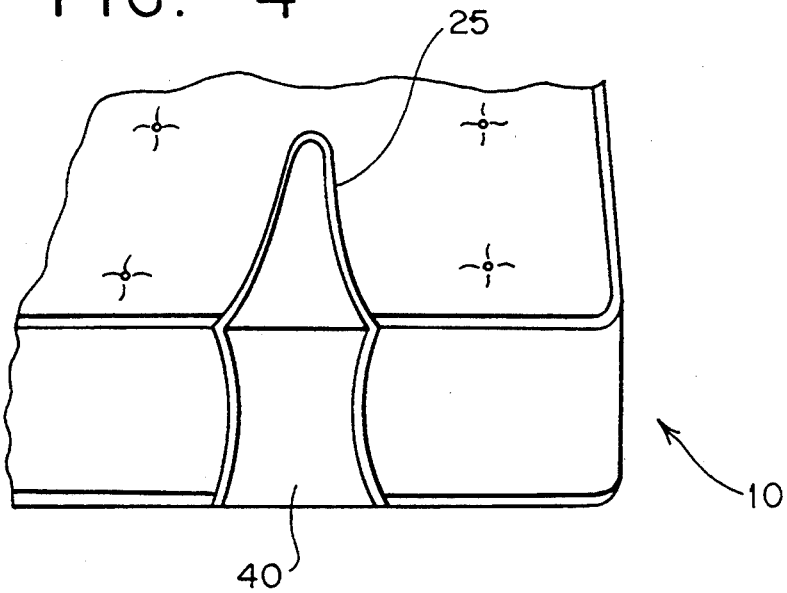
FIG. 4 is a perspective view of a mattress with an insert in place.

According to an alternative embodiment of the present invention shown in FIGS. 4 and 5, a removable insert 40 is provided for each opening 20. Insert 40 is designed to fit snugly within opening 20 while complementing the contours of sidewalls 25 of opening 20. Thus, sidewalls 45 of inserts 40 are preferably substantially concave such that they can receive the convex tapers of sidewalls 25. From the present description, it will be appreciated that inserts 40 can be readily inserted or removed as desired by the mattress user. Inserts 40 may be formed of a material identical to or quite different from the rest of the mattress.

In addition to filling an opening for a partner or house guest who does not wish to take advantage of the opening of the present invention, inserts may also be utilized to fill the openings of a mattress having a greater number of openings that the mattresses shown in the Figures. Those in the mattress industry will appreciate that it is often recommended that users flip and rotate their mattresses on a regular basis in order to avoid the formation of permanent depression in a single area of the mattress. If a mattress such as the mattress illustrated in FIG. 1 was flipped in a certain way, the openings 20 normally present at the superior end of the mattress would end up proximate the feet of the resting person. Instead of changing their sleeping position within a room, if the mattress of FIG. 1 was provided with similar openings at the inferior end, all a person would have to do would be to remove inserts 40 from one end and place these inserts into the openings which are then proximate the user's feet. Such additional openings would thereby tend to extend the useful life of a mattress of the present invention.

As a further alternative to the embodiment illustrated in FIGS. 4 and 5, a person desiring to switch to a supine, i.e. face up, position can simply place a pillow over the opening. In this manner, the opening can be utilized when it is desired and covered when it is not desired.

Figure 7:
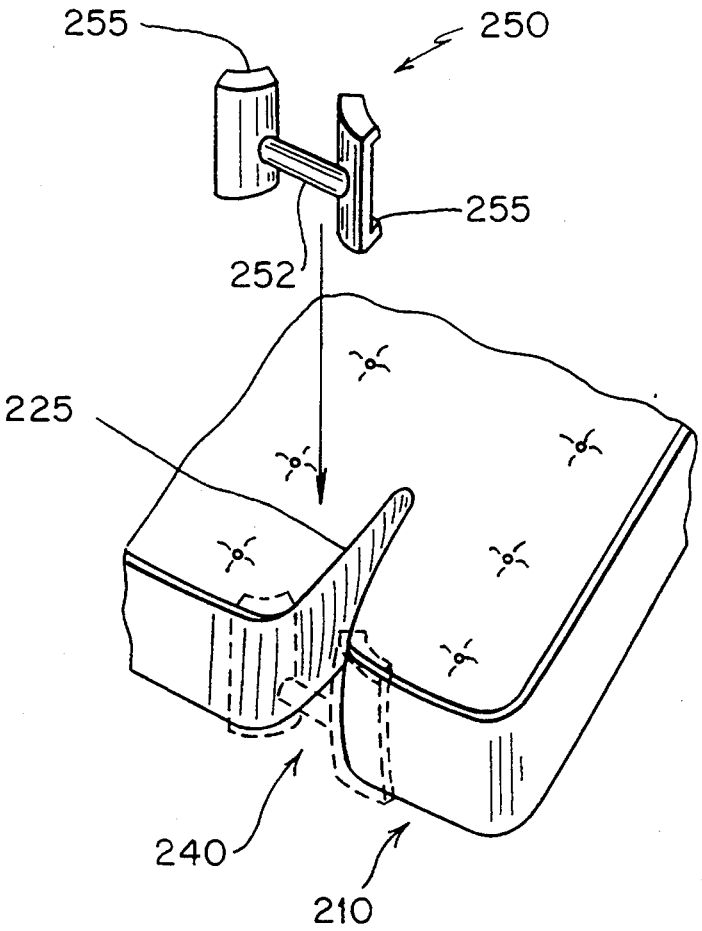
FIG. 7 illustrates an alternative embodiment of the present invention comprising an adjustment member for the opening.

According to still another embodiment of the present invention illustrated in FIG. 7, an adjustment member is provided for widening the width of the opening. The adjustment member 250 has a length which is greater than the normal, i.e. unstressed, width of the opening to which the adjustment member 250 will be inserted. For example, if the adjustment member 250 is to be inserted into the opening proximate the superior end of the opening which has a width of nine inches, the adjustment member may have a length of 10–12 inches. The illustrated adjustment member 250 comprises a crossbar 252 and is also advantageously provided with outwardly facing abutment walls 255 for grabbing the inner sidewalls 225 and maintaining the positioning of adjustment member 250 in opening 240. When a person desires a slightly wider opening 240, the adjustment member 250 is simply inserted into the opening proximate the superior end of mattress 210. One way of inserting adjustment member 250 into opening 240 is illustrated in phantom in FIG. 7.

Figure 8:
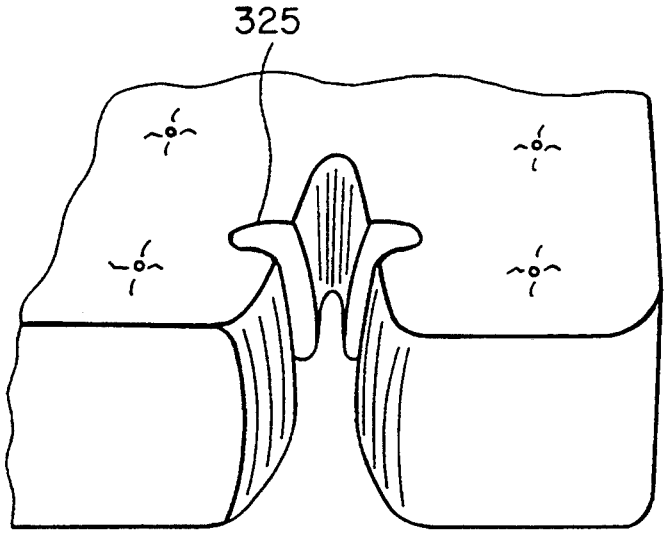
FIG. 8 is a perspective view illustrating an opening of an alternative embodiment of the present invention.

The interior sidewalls of the openings of the present invention preferably, but do not necessarily, continuously taper from the superior end to the inferior end. In the embodiment shown in FIG. 8, sidewalls 325 diverge for a portion of their length in order to provide even greater space for circulating air. A major portion of these sidewalls, i.e. a portion corresponding to at least half of the length of the central longitudinal axis, converge. This converging portion is preferably, but not necessarily, continuous.

Figure 9:
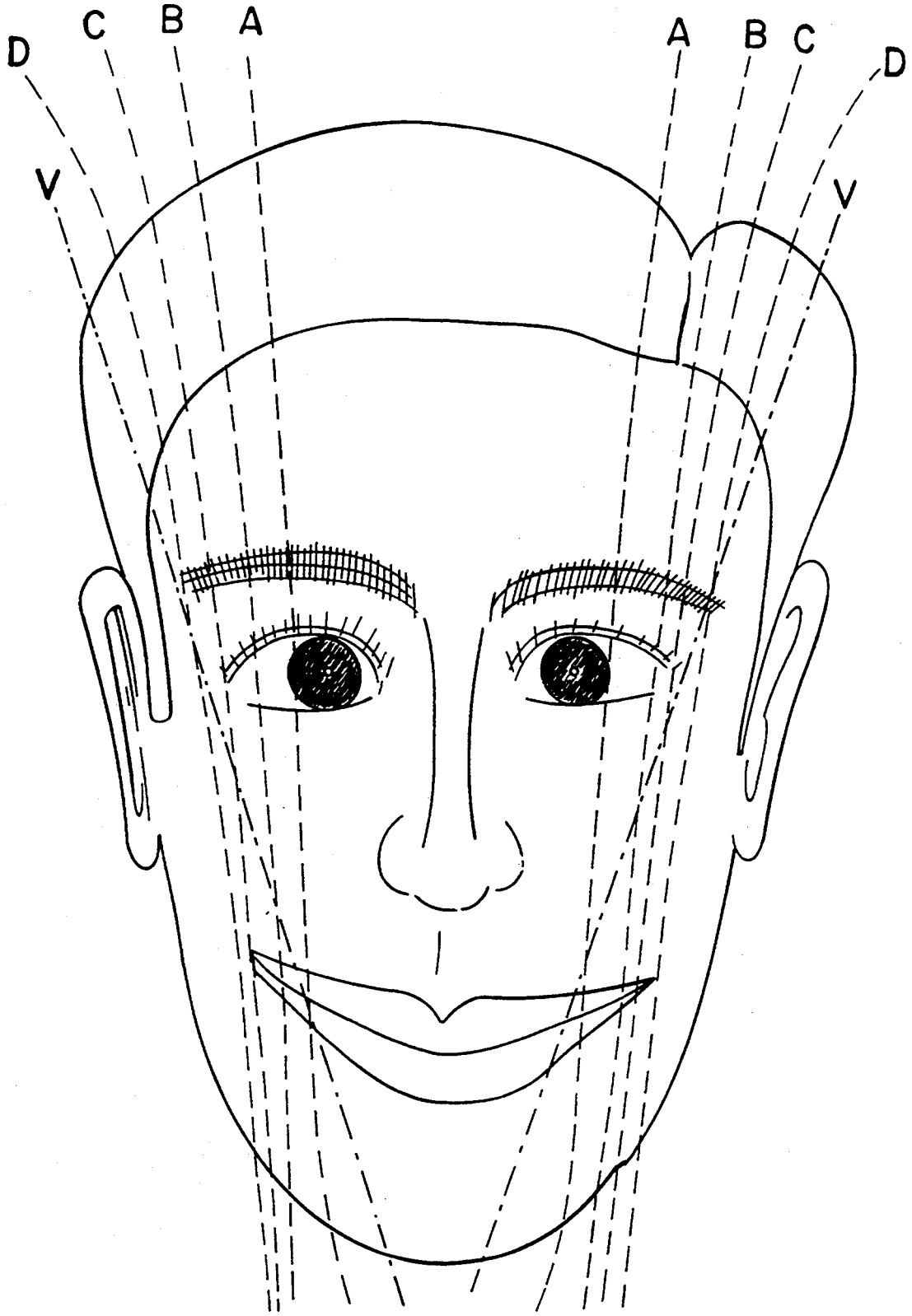
FIG. 9 is a frontal view of a face indicating areas where a head can be supported by the present invention.

The advantages of the present invention are further illustrated in FIG. 9 which illustrates a face. Lines V outline the substantially triangular aspects of the skull. They extend from the mandibular bone to the lateral aspects of the orbits which are also supported by the zygomas (cheek bones). Converging lines A–D indicate portions of the skull which are preferably supported by the tapering sides of an opening of the embodiment of the present invention shown in FIGS. 1 and 2. It will be appreciated that the tapering configuration of the openings of the present invention provide more comfortable support allowing the skull to remain relatively horizontal and the neck in a less stressed position than would a rectangular opening. The tapering configuration of the various embodiments of the present invention comfortably supports different head sizes having different face shapes. The present invention also allows a resting person to change the area on his/her face being contacted by the mattress. By shifting forwardly toward the superior end of the mattress, the contact areas will be spread further apart. Conversely, by shifting toward the inferior end of the bed, the person's face will contact a narrower portion of the opening and cause an area of contact to be closer together.

The mattresses of the present invention can be any size including twin, full, queen and king sizes or may be used with less conventional sizes while still providing the aforementioned benefits. When a mattress of present invention is utilized along with a box spring 75, wooden platform 70, or other support, that support may also be provided with a similar opening in order to enhance the free flow of air to and from the person resting.

Figure 6:
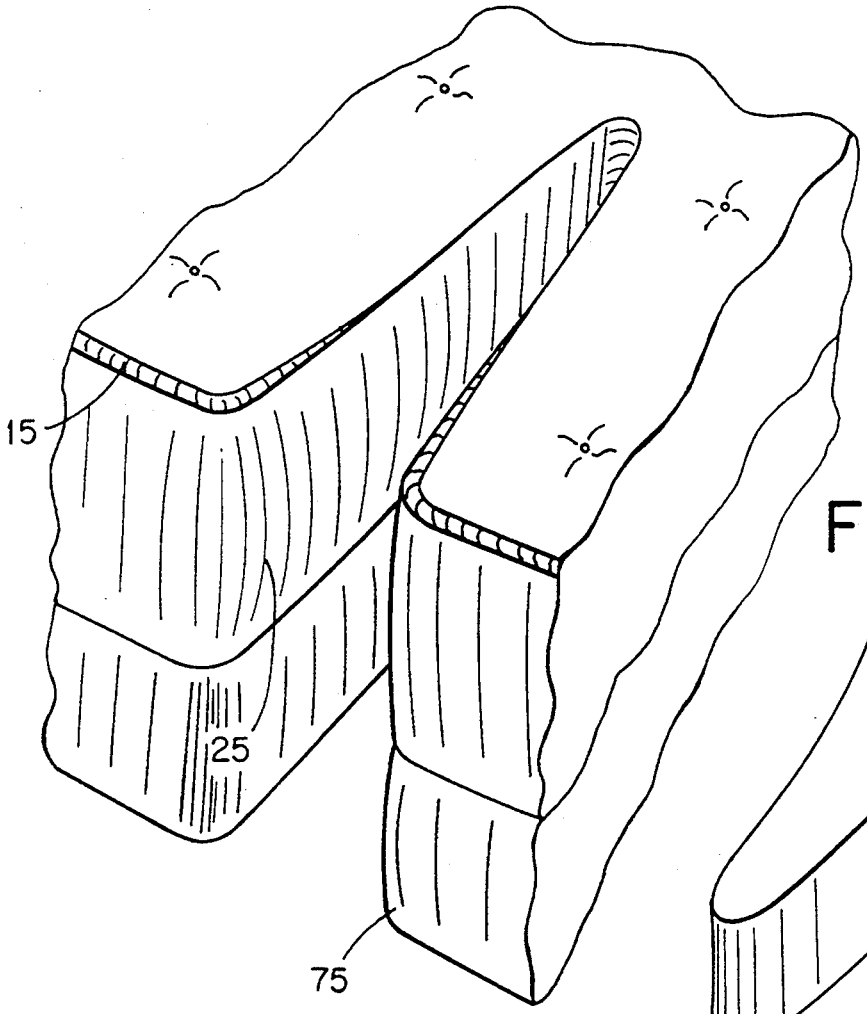
FIG. 6 is a partial, perspective view from the superior end of the mattress shown in FIG. 1.

As shown in FIG. 6, the mattress piping 15 which extends around the edges of the illustrated mattress, is preferably recessed to provide a smooth contour to the inner edge in the opening area in order to maximize facial comfort for the person resting. Outside the opening area, the piping 15 may be more prominent as on conventional mattresses.

Figure 3:
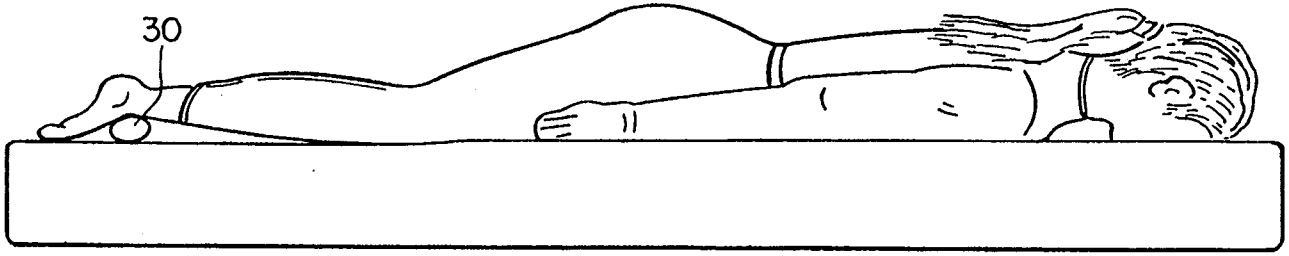
FIG. 3 is a side, perspective view of a single size mattress showing a placement of a person's face and another optional aspect of the present invention.

A still further embodiment of the present invention illustrated in FIG. 3, comprises an adjustable instep cushion 30. Instep cushion 30 is designed to comfortably support the instep of a person resting in the prone position. The position of the instep cushion 30 can be readily adjusted by providing the cushion and the mattress or a suitable mattress cover with some form of adjustable attachment, such as VELCRO®. From the description provided herein, it will be appreciated that the instep cushion 30 may be used with any of the previously described embodiments as desired by the person resting.

Figure 10:
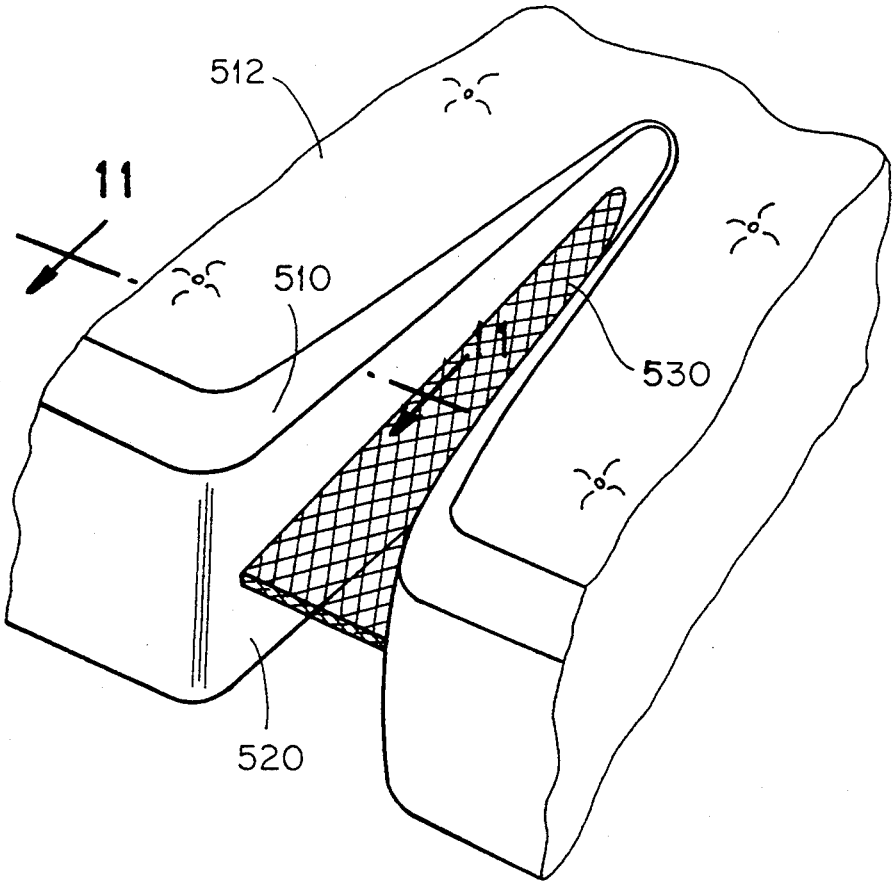
FIG. 10 is a partial, perspective view of the superior end of an alternative embodiment of the present invention.
Figure 11:
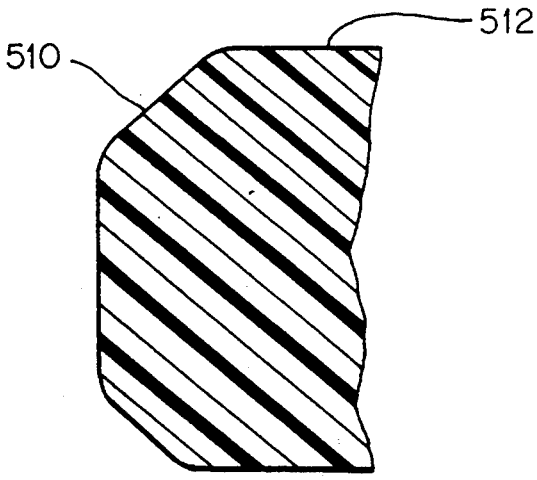
FIG. 11 is a cross-sectional view taken along lines 11—11 of FIG. 10.

Another preferred embodiment of the present invention is illustrated in FIGS. 10–12. In this embodiment, the interior sidewalls of the opening are formed with a bevel which forms a first interior sidewall 510. The first interior sidewall preferably slopes downwardly from the upper resting surface 512 of the resting support at an angle of about 30° to 60°, preferably about 40° to 50°, as measured from the plane of the upper support surface of the mattress. The span of the opening of this embodiment of the present invention as measured from the lower edge of the first interior sidewall is about 5–10 inches, preferably about 6–8 inches at the superior end of the opening and, at a distance about 2 inches from the inferior end, is about one-half to 3 inches, most preferably about 1–2 inches. Those skilled in the art will appreciate that the angles of the first interior sidewalls and the distances between opposing sidewalls can be varied without departing from the scope of the present invention. This first interior sidewall 510 is designed to increase the facial-mattress contact to provide a more comfortable resting surface. As shown in FIGS. 10–12, the first interior sidewall 510 preferably extends around substantially the entire rim of the opening. As best shown in FIG. 10, a second interior sidewall 520 extends from the lower portion of first interior sidewall 510 at an angle sloped downwardly and steeper than first interior sidewall 510. Second interior sidewall 520 may have the same general shape as interior sidewall 25 of the embodiment shown in FIG. 6 above.

While the dimensions of the opening of this embodiment of the present invention may vary, the width of the first interior sidewall preferably ranges from about one-half to about 3 inches, most preferably about 1–2 inches. The width of first interior sidewall 510 which is available for facial-mattress contact can advantageously be greater near the center of the opening. Thus the width of the first interior sidewall 510 is not necessarily constant around the top of the opening. As illustrated in FIG. 11, this embodiment is also preferably formed with symmetrical openings on both the top and bottom of the mattress in order to facilitate use with either side facing upwardly.

Another aspect of the present invention, illustrated in FIG. 12, comprises a supplemental support which can be used with the various embodiments of resting supports described above. The supplemental support 540 is preferably formed of a resilient material and is selectively removable and positionable within any of the openings described herein. For example, the support 540 can be formed of a polyurethane foam and is preferably covered, for example, with a muslin ticking and a removable, washable sheet material such as broadcloth or percale. One advantage of the supplemental support is that it provides additional facial-mattress contact area in the area of the user's forehead and therefore reduces the pressure on the person's cheeks.

In a preferred supplemental support illustrated in FIGS. 13–15, supplemental support 550 has a generally concave upper surface 551 and sidewalls 553 which taper inwardly. As best shown in the frontal view of FIG. 14, the sidewalls 553 of the illustrated supplemental support 550 taper downwardly such that the bottom side 555 of supplemental support 550 is smaller than the distance across the concave upper surface 551.

While the dimensions of the supplemental support may vary, the superior and inferior ends may have a width of about 5–6 inches and extend downwardly into the opening for a distance of about 3 inches. Those skilled in the art will appreciate that different sizes and shapes of supplemental supports may be utilized without departing from the scope of the present invention.

It will also be appreciated that suitably configured sheets or other removable covers can be designed to conform to the novel resting supports and supplemental supports disclosed herein. FIG. 16 illustrates a washable bedding sheet 600 particularly adapted for use with a mattress of the type shown in FIG. 6. Sheet 600 comprises an upper, substantially planar surface 610, a beveled surface 620 and a downwardly-extending surface 625 adapted to conform to the mattress opening shown in FIG. 10.

The various mattresses of the present invention are preferably used with supports such as boxsprings having corresponding openings. A boxspring is preferably positioned below the mattress of the type shown in FIG. 10. The boxspring advantageously has an opening which is larger than the mattress opening in order to enhance the free circulation of fresh air. The opening in the boxspring is also provided with a porous mesh 530 designed to inhibit any dust located below the bed from interfering with the breathing of the person resting.

I claim:

1. A resting support comprising:

an upper substantially planar, resting surface comprising edge portions, a superior end and an inferior end;

exterior sidewalls extending downwardly from areas proximate said edge portions of said upper surface;

at least one interior slot adapted to receive the face of a person resting in a prone position; said slot comprising a longitudinal axis, said slot defined by:

a first interior sidewall having an upper portion and a lower portion, said first interior sidewall extending downwardly from said resting surface and tapering inwardly toward said longitudinal axis, said first interior sidewall also tapering inwardly from said superior end to said interior end thereof; and a second interior sidewall extending downwardly from said lower portion of said first interior sidewall and extending downwardly away from said resting area surface at a steeper angle than said first interior sidewall.

2. A resting support according to claim 1 wherein said first interior sidewall is substantially flat.

3. A resting support according to claim 2 wherein said first interior sidewall extends a distance of about 0.5–4 inches.

4. A resting support according to claim 1 wherein said first interior sidewall extends a distance of about 1–3 inches.

5. A resting support according to claim 1 wherein said first interior sidewall extends continuously around said slot.

6. A resting support according to claim 1 wherein said slot is further defined by a third interior sidewall which is disposed below said second interior sidewall.

7. A resting support according to claim 6 wherein said third interior sidewall diverges outwardly away from said longitudinal axis.

8. A resting support according to claim 1 further comprising a removable facial support.

9. A resting support according to claim 1 wherein said resting support comprises at least two interior slots.

10. A resting support according to claim 1 in combination with a boxspring comprising at least one interior slot which is aligned with said interior slot of said resting support.

11. A resting support according to claim 10 wherein said interior slot of said boxspring is larger than said interior slot of said resting support.

12. A resting support according to claim 10 in combination with a boxspring further comprising a porous mesh disposed in said slot of said boxspring.

13. A resting support according to claim 1 further comprising an insert having a shape substantially similar to said opening such that said insert may be selectively positioned within said opening thereby substantially filling said opening.

14. A resting support according to claim 1 in combination with a second support disposed below said support and in contact with said support, wherein said second support also comprises an opening which is aligned with at least a portion of said opening of said support.

15. A resting support according to claim 14 wherein said second support comprises a box spring.

16. A resting support according to claim 14 wherein said second support comprises a wooden platform.

17. A resting support according to claim 1 further comprising:

a removable supplemental facial cushion which spans said opening to support the forehead of a person resting in a prone position.

18. A horizontal support according to claim 17 wherein said supplemental facial cushion comprises a substantially concave upper surface.

19. A bed comprising:

a mattress comprising:

an upper substantially planar, resting surface comprising edge portions, superior end and an interior end;

exterior sidewalls extending downwardly from areas proximate said edge portions of said upper surface;

at least one interior slot adapted to receive the face of a person resting in a prone position, said slot comprising a longitudinal axis, said slot defined by:

a first interior sidewall having an upper portion and a lower portion, said first interior sidewall extending downwardly from said resting surface and tapering inwardly toward said longitudinal axis, said first interior sidewall also tapering inwardly from said superior end to said interior end thereof;

a second interior sidewall extending downwardly from said lower portion of said first interior sidewall and extending downwardly away from said resting surface at a steeper angle than said first interior sidewall; and a boxspring comprising at least one interior slot corresponding to said interior slot of said mattress.

20. A bed according to claim 19 wherein said first interior sidewall extends a distance of about 0.5–4 inches.

21. A bed according to claim 19 wherein said first interior sidewall extends a distance of about 1–3 inches.

22. A bed according to claim 19 wherein said first interior sidewall extends continuously around said slot.

23. A bed according to claim 19 wherein said slot is further defined by a third interior sidewall which is disposed below said second interior sidewall.

24. A bed according to claim 19 further comprising a removable facial support.

25. A bed according to claim 24 wherein said removable facial support comprises a substantially concave upper surface.

26. A bed according to claim 19 wherein said boxspring comprises a porous mesh disposed in said slot of said boxspring.

27. A mattress adapted for comfortably supporting a person in a prone position comprising:

a resilient support comprising a superior end and an inferior end for supporting the upper and lower portions, respectively, of a person, a substantially planar top surface, a substantially planar lower surface, and at least one outer sidewall extending downwardly for at least 3 inches from said upper surface to said lower surface; and an opening in said mattress extending from said superior end toward said inferior end comprising inner sidewalls, wherein said sidewalls are spaced at said superior end and converge with a gradual, continuous taper, from a first area proximate said superior end of said support to a second area closer to said inferior end of said support to engage and support the cheeks of a person resting with the person's face in said opening without blocking the flow of air to the person's mouth and nose.

28. A mattress according to claim 27 wherein a major portion of said inner sidewalls are substantially straight.

29. A mattress according to claim 27 wherein at least one of said inner sidewalls comprises a portion which diverges from an opposite portion of the other sidewall.

30. A mattress according to claim 27 wherein said opening extends from said superior end of said mattress toward said inferior end of said mattress for a distance of about b 15–25 inches.

31. A mattress according to claim 30 wherein said inner sidewalls are spaced by a distance of about 7–12 inches in said first area.

32. A mattress according to claim 31 wherein said opening comprises a superior end and an inferior end, and wherein said inner sidewalls are spaced by a distance of about 1.5–4 inches at a point two inches from the inferior end of said opening.

33. A mattress according to claim 27 wherein said inner sidewalls are spaced by a distance of about 8–10 inches in said first area.

34. A mattress according to claim 27 wherein said opening comprises a superior end and an inferior end, and wherein said inner sidewalls are spaced by a distance of about 2–3 inches at a point two inches from the inferior end of said opening.

35. A mattress according to claim 27 wherein said outer sidewalls extend downwardly from said support for a distance of about 2–12 inches.

36. A mattress according to claim 27 wherein said outer sidewalls extend downwardly from said support for a distance of about 3–8 inches.

37. A mattress according to claim 27 further comprising an instep cushion positioned proximate said inferior end of said support.

38. A mattress according to claim 37 wherein said instep cushion is selectively positionable on said support.

39. A mattress according to claim 27 further comprising an insert having a shape substantially similar to said opening such that said insert may be selectively positioned within said opening thereby substantially filling said opening.

40. A mattress according to claim 27 in combination with a second support disposed below said support and in contact with said support, wherein said second support also comprises an opening which is aligned with at least a portion of said opening of said support.

41. A mattress according to claim 40 wherein said second support comprises a box spring.

42. A mattress according to claim 40 wherein said second support comprises a wooden platform.

43. A mattress according to claim 27 wherein said opening extends downwardly in said second area for a distance of at least two inches.

44. A mattress according to claim 27 wherein said opening extends downwardly in said second area for substantially the entire depth of said mattress.

45. A mattress according to claim 44 wherein said inner sidewalls extend downwardly and converge proximate the bottom of said mattress.

46. A mattress according to claim 27 wherein said opening extends downwardly in said second area through said mattress.

47. A mattress according to claim 27 wherein said inner sidewalls converge inwardly in the direction extending from the top of said mattress to the bottom of said mattress for at least a portion of the depth of said opening.

48. A mattress according to claim 27 further comprising means for adjusting the width of said opening.

49. A substantially horizontal support adapted to comfortably support a resting person comprising:

a first resilient support comprising a superior end and an inferior end for supporting the head and lower body portions, respectively, of a person;

at least one outer sidewall extending downwardly from said support; and an opening in said support comprising inner sidewalls, wherein said inner sidewalls extend downwardly and are spaced to engage and support the cheeks of a person resting with the person's face in said opening without blocking the flow of air to the person's mouth and nose, said inner sidewalls being spaced at said superior end and converging from a first area proximate said superior end of said support to a second area closer to said inferior end of said support, said opening comprising a face-engaging portion which tapers gradually and continuously in a direction from said superior end toward said inferior end thereof.

50. A substantially horizontal support adapted to comfortably support a resting person according to claim 49 further comprising a second support disposed below said first support and in contact with said first support, wherein said second support also comprises an opening which is aligned with at least a portion of said opening of said first support.

51. A substantially horizontal support adapted to comfortably support a resting person according to claim 49 wherein a major portion of said inner sidewalls converge substantially continuously.

52. A substantially horizontal support adapted to comfortably support a resting person according to claim 49 wherein a major portion of said inner sidewalls are substantially straight.

53. A substantially horizontal support adapted to comfortably support a resting person according to claim 49 wherein at least one of said inner sidewalls comprises a portion which diverges from an opposite portion of the other sidewall.

54. A substantially horizontal support adapted to comfortably support a resting person according to claim 49 wherein said opening extends from said superior end of said support toward said inferior end of said support for a distance of about 15–25 inches.

55. A substantially horizontal support adapted to comfortably support a resting person according to claim 54 wherein said inner sidewalls are spaced by a distance of about 7–12 inches in said first area.

56. A substantially horizontal support adapted to comfortably support a resting person according to claim 55 wherein said opening comprises a superior end and an inferior end, and wherein said inner sidewalls are spaced by a distance of about 1.5–4 inches at a point two inches from the inferior end of said opening.

57. A substantially horizontal support adapted to comfortably support a resting person according to claim 49 wherein said inner sidewalls are spaced by a distance of about 8–10 inches in said first area.

58. A substantially horizontal support adapted to comfortably support a resting person according to claim 49 wherein said opening comprises a superior end and an inferior end, and wherein said inner sidewalls are spaced by a distance of about 2–3 inches at a point two inches from the inferior end of said opening.

59. A substantially horizontal support adapted to comfortably support a resting person according to claim 49 wherein said outer sidewalls extend downwardly from said support for a distance of about 2–12 inches.

60. A substantially horizontal support adapted to comfortably support a resting person according to claim 49 wherein said outer sidewalls extend downwardly from said support for a distance of about 3–8 inches.

61. A substantially horizontal support adapted to comfortably support a resting person according to claim 49 further comprising an instep cushion positioned proximate said inferior end of said support.

62. A substantially horizontal support adapted to comfortably support a resting person according to claim 61 wherein said cushion is selectively positionable on said support.

63. A substantially horizontal support adapted to comfortably support a resting person according to claim 49 further comprising an insert having a shape substantially similar to said opening such that said insert may be selectively positioned within said opening thereby substantially filling said opening.

64. A resting support comprising:

an upper substantial planar, resting surface comprising a superior end and an inferior end;

at least one interior slot adapted to receive the face of a person resting in a prone position, said slot comprising a longitudinal axis, said slot defined by:

a first interior sidewall extending from a position proximate said superior end toward said inferior end wherein said first interior sidewall is narrower proximate said inferior end thereof than at said superior end thereof, said interior sidewall further comprising an upper portion and a lower portion, and extending downwardly from said resting surface and tapering inwardly toward said longitudinal axis; and a second interior sidewall extending downwardly from said lower portion of said first interior sidewall and extending downwardly away from said resting surface at a steeper angle than said first interior sidewall.

* * * * *